US011073784B2

(12) United States Patent
Collie et al.

(10) Patent No.: US 11,073,784 B2
(45) Date of Patent: Jul. 27, 2021

(54) PRINT SUPPLY LOCKS

(71) Applicant: Hewlett-Packard Development Company, L.P., Spring, TX (US)

(72) Inventors: Lynn A Collie, Vancouver, WA (US); Wesley R Schalk, Vancouver, WA (US); Vern Elliot Myers, Vancouver, WA (US); John Connell, Vancouver, WA (US); Paul Osborne, Vancouver, WA (US); Kevin Lo, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/981,721

(22) PCT Filed: Mar. 29, 2018

(86) PCT No.: PCT/US2018/025175
§ 371 (c)(1),
(2) Date: Sep. 17, 2020

(87) PCT Pub. No.: WO2019/190528
PCT Pub. Date: Oct. 3, 2019

(65) Prior Publication Data

US 2021/0116852 A1 Apr. 22, 2021

(51) Int. Cl.

| | |
|---|---|
| ***G03G 21/16*** | (2006.01) |
| ***G03G 15/00*** | (2006.01) |
| ***B41J 2/175*** | (2006.01) |

(52) U.S. Cl.
CPC ..... *G03G 21/1647* (2013.01); *B41J 2/1752* (2013.01); *G03G 15/556* (2013.01); *G03G 21/1676* (2013.01)

(58) Field of Classification Search
CPC .... G03G 15/55; G03G 15/553; G03G 15/556; G03G 21/1647; G03G 21/1676; G03G 2221/163; B41J 2/1752
See application file for complete search history.

(56) References Cited

U.S. PATENT DOCUMENTS

| | | | | |
|---|---|---|---|---|
| 3,349,886 | A | 10/1967 | Madison | |
| 4,736,213 | A | 4/1988 | Piatt et al. | |
| 5,802,435 | A | 9/1998 | Trask et al. | |
| 6,065,829 | A | 5/2000 | Ruiz et al. | |
| 6,347,199 | B1 | 2/2002 | Morihara | |
| 6,352,326 | B1 * | 3/2002 | Maeda | B41J 11/008 347/12 |
| 6,560,416 | B2 | 5/2003 | Fischer | |
| 7,778,556 | B2 | 8/2010 | Ohkawa et al. | |
| 8,498,546 | B2 | 7/2013 | Inoue | |
| 9,274,484 | B2 | 3/2016 | Nakajima | |

(Continued)

FOREIGN PATENT DOCUMENTS

JP 2015063115 A 4/2015

*Primary Examiner* — Sophia S Chen
(74) *Attorney, Agent, or Firm* — Brooks Cameron & Huebsch PLLP

(57) ABSTRACT

An example apparatus may include a supply guide to receive a plurality of print supplies and a lock mechanism to retain the plurality of print supplies and release a print supply of the plurality of print supplies responsive to a determination that an amount of print substance in the print supply is at or below a threshold level.

13 Claims, 5 Drawing Sheets

(56) References Cited

U.S. PATENT DOCUMENTS

| | | | | |
|---|---|---|---|---|
| 2009/0141100 | A1 | 6/2009 | Nakamura | |
| 2010/0245502 | A1 | 9/2010 | Kanbe | |
| 2011/0058825 | A1* | 3/2011 | Tsukijima | G03G 21/1676 399/27 |
| 2014/0267494 | A1 | 9/2014 | Yamamoto | |
| 2016/0054680 | A1* | 2/2016 | Okuda | G03G 21/1676 399/258 |
| 2017/0102637 | A1* | 4/2017 | Seto | G03G 21/1676 |
| 2018/0113414 | A1* | 4/2018 | Ando | G03G 15/0855 |
| 2019/0265636 | A1* | 8/2019 | Teshima | G03G 21/1647 |
| 2019/0286041 | A1* | 9/2019 | Soda | G03G 15/556 |

* cited by examiner

PRINT SUPPLY LOCKS

BACKGROUND

Imaging systems, such as printers, copiers, etc., may generate text, images, or objects on print media (e.g., paper, plastic, a bed of build material in the case of Three-Dimensional (3D) printing, etc.). In some examples, imaging systems may perform a print job comprising printing text and/or graphics by transferring print substance (e.g., ink, toner, binding agent, etc.) to print media.

DETAILED DESCRIPTION

Print supply locks and systems are described herein. In some examples, print supply locks may prevent the removal of print supply before the print supply is depleted. That is, print supply locks may prevent premature disposal of print supply containing more than a threshold level of print substance. In some examples, a lock mechanism may lock a print supply into a supply guide until the print supply is depleted or near depletion. That is, the lock mechanism may lock a print supply into a supply guide until the print supply has reached a threshold level of print substance. In some examples, the printing device may release the print supply from the lock mechanism when the amount of print substance in the print supply is at or below a threshold level. As used herein, a threshold level refers to the amount of print substance in a print supply being at or near depletion. As used herein, depletion refers to a level of print substance in a print supply at which the printing device is designed to no longer operate and/or is inoperable. However, it is noted that as contemplated by the present disclosure, a threshold level may be set to be otherwise than at or near depletion.

In some examples, the print supply lock may include a hidden manual release mechanism. In some examples, the manual release mechanism may cause a lock mechanism to disengage. In some examples, the printing device may release the print supply from the lock mechanism, when the manual release mechanism is actuated. In various examples, when the manual release mechanism has not initiated and the print supply is not depleted the lock mechanism may prevent the removal of the print supply. Accordingly, this detailed description describes print supply locks that prevent premature removal of a print supply from a printing device.

Figure 1:
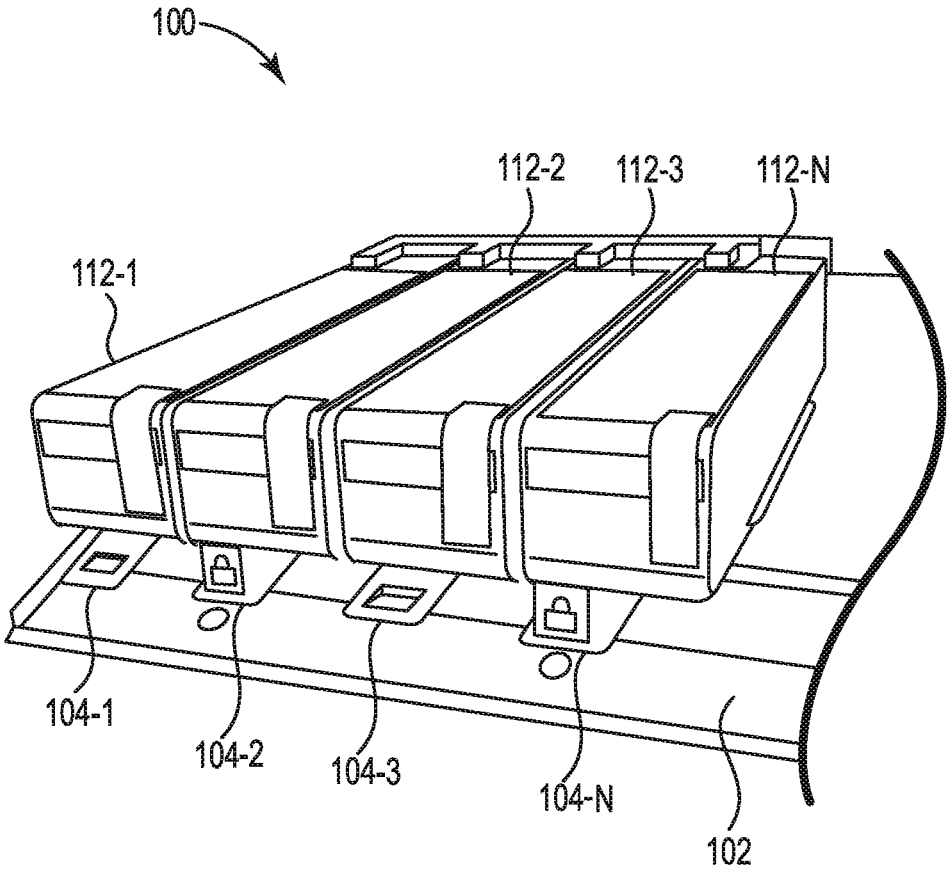
FIG. 1 illustrates an example apparatus including a print supply lock.

FIG. 1 illustrates an example apparatus 100 including a print supply lock. The apparatus 100 may be implemented in a variety of imaging systems, such as printers, copiers, etc., for example. In some examples, the apparatus 100 may include a supply guide 102. In some examples, the supply guide 102 may hold a print supply 112-1, 112-2, 112-3, or 112-N. In some examples, the supply guide 102 may hold a plurality of print supplies 112-1, 112-2, 112-3, and/or 112-N.

While print supplies are listed as 112-1, 112-2, 112-3, and/or 112-N, it is understood that more or less print supplies may be used. In some examples, the supply guide 102 may be coupled to the lock mechanism 104. Lock mechanism 104 collectively refers to 104-1, 104-2, 104-3, and/or 104-N. While the lock mechanism is shown to have components 104-1, 104-2, 104-3, and/or 104-N, it is understood that more or less components may be used. In some examples, the supply guide 102 may connect the lock mechanism 104 to the print supplies 112-1, 112-2, 112-3, and/or 112-N. In some examples, the supply guide 102 may include a retention mechanism to hold the print supplies 112-1, 112-2, 112-3, and 112-N to the supply guide 102.

In some examples, the lock mechanism 104 may lock a plurality of print supplies 112-1, 112-2, 112-3, and 112-N into the supply guide 102. For example, when a print supply 112-1 is inserted into the supply guide 102 the lock mechanism 104-1 may prevent the retention mechanism from releasing the print supply 112-1. In some examples, when the print supply 112-1, 112-2, 112-3, or 112-N is inserted into the supply guide 102 a lock mechanism 104 may automatically engage and lock the print supply 112-1, 112-2, 112-3, or 112-N to the supply guide 102. In some examples, the lock mechanism 104 may lock the print supplies 112-1, 112-2, 112-3, and 112-N to the supply guide 102 until the amount of print substance in the print supply reaches a threshold level. In some examples, the lock mechanism 104 may unlock the print supply 112-1, 112-2, 112-3, or 112-N when a manual release mechanism is actuated. For example, the manual release mechanism may cause the lock mechanism 104 to unlock the print supplies 112-1, 112-2, 112-3, and 112-N when the amount of print substance in the print supplies have not reached a threshold level.

In some examples, the lock mechanism 104 may unlock the print supplies 112-1, 112-2, 112-3, and 112-N from the supply guide 102 when the amount of print substance in the print supplies are at or below a threshold level. In some examples, the lock mechanism 104 may individually lock the print supplies 112-1, 112-2, 112-3, and 112-N into the supply guide 102. In some examples, the lock mechanism 104 may individually unlock the print supplies 112-1, 112-2, 112-3, and 112-N when the amount of print substance in a particular print supply 112-1, 112-2, 112-3, or 112-N is at or below a threshold level. For example, the lock mechanism 104-3 may unlock print supply 112-3 when the amount of print substance in the print supply 112-3 reaches a threshold and the lock mechanism 104-1, 104-2, and 104-N may continue to lock print supplies 112-1, 112-2, and 112-N when the amount of print substance in the print supplies have not reached a threshold level.

In some examples, locking the print supply 112-1, 112-2, 112-3, or 112-N to the supply guide 102 until a threshold level is reached may prevent premature disposal of the print supply 112-1, 112-2, 112-3, or 112-N. That is, preventing premature disposal of print supply 112-1, 112-2, 112-3, or 112-N may reduce the cost of the printing process. In some examples, preventing the removal of print supply 112-1, 112-2, 112-3, or 112-N may prevent theft of the print supply 112-1, 112-2, 112-3, or 112-N. That is, locking print supply 112-1, 112-2, 112-3, or 112-N to the supply guide 102 may stop unwanted removal of the print supply 112-1, 112-2, 112-3, or 112-N from the supply guide 102.

In some examples, the lock mechanism 104 may lock the print supplies 112-1, 112-2, 112-3, and 112-N into the supply guide 102 by entering an opening at the bottom of the print supplies 112-1, 112-2, 112-3, and 112-N. For example, when the lock mechanism 104 is actuated, the lock mechanism 104 may move towards an opening at the bottom the print supplies 112-1, 112-2, 112-3, and 112-N to prevent the print supplies 112-1, 112-2, 112-3, and 112-N from being removed from the supply guide 102, In some examples, the lock mechanism 104 may unlock the print supplies 112-1, 112-2, 112-3, and 112-N by exiting the opening at the bottom of the print supplies 112-1, 112-2, 112-3, and 112-N. For example, when the lock mechanism 104 is disengaged, the lock mechanism 104 may move away from the opening at the bottom the print supplies 112-1, 112-2, 112-3, and 112-N allowing the print supplies 112-1, 112-2, 112-3, and 112-N to be removed. While the term bottom is used, it is noted that other possible orientations may be used in order to practice the examples of this detailed description.

Figure 2:
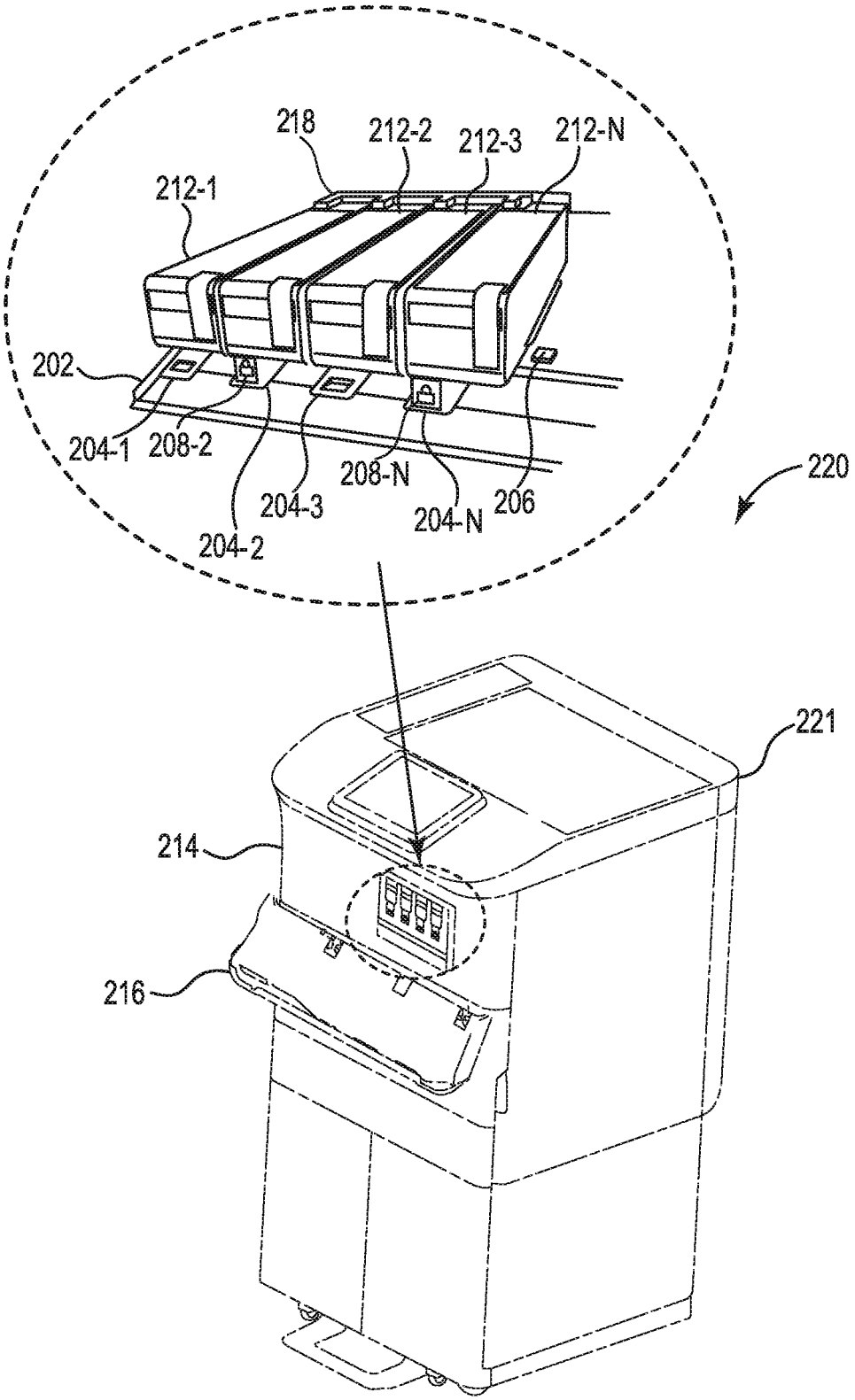
FIG. 2 illustrates an example system including a print supply lock.

FIG. 2 illustrates an example system 220 including a print supply lock. In some examples, the system 220 may include a printing device 221. In some examples, the system 220 may include an enclosure 214 disposed in a printing device 221. In some examples, the enclosure 214 may house a supply guide 202. In some examples, the supply guide 202 may be positioned in the center of the enclosure 214. In some examples, the supply guide 202 may be positioned in other parts of the enclosure 214. For example, the supply guide 202 may be positioned at the distal end of the enclosure 214. As used herein, distal end refers to an end that is within fifteen percent of the outer most regions of an object.

In some examples, the enclosure 214 may be a removable enclosure. For example, the enclosure 214 may be inserted into a printing device 221 to customize the printing device 221 with the features of the enclosure 214. In some examples, the enclosure 214 may include a door 216 to cover the supply guide 202. As used herein, a door refers to a hinged, sliding, or revolving barrier at an opening of a printing device. In some examples, the door 216 may cover the enclosure 214 when in a closed position. In some examples, closing the door 216 may cause the lock mechanism 204 to initiate. Lock mechanism 204 collectively refers to 204-1, 204-2, 204-3, and/or 204-N. In some examples, when the print supplies 212-1, 212-2, 212-3, and 212-N are inserted into the supply guide 202, the lock mechanism 204 may engage and lock the print supplies 212-1, 212-2, 212-3, and 212-N to the supply guide 202 when the door 216 is closed. For example, when the print supplies 212-1, 212-2, 212-3, and 212-N are unlocked and a user closes the door 216 without removing a print supply 212-1, 212-2, 212-3, or 212-N the lock mechanism 204 may initiate and lock the print supplies 212-1, 212-2, 212-3, and 212-N into the supply guide 202.

In some examples, the supply guide 202 may support a plurality of print supplies 212-1, 212-2, 212-3, and 212-N. In some examples, the supply guide 202 may include a retention mechanism 218 to secure the print supplies 212-1, 212-2, 212-3, and 212-N to the supply guide 202 until a release is initiated. In various examples, a print supply 212-1, 212-2, 212-3, or 212-N may be inserted into the supply guide 202 by pushing the print supply 212-1, 212-2, 212-3, or 212-N into the supply guide 202 and contacting the retention mechanism 218. That is, when the print supplies 212-1, 212-2, 212-3, and 212-N are pushed into the supply guide 202 the print supplies may contact the retention mechanism 218 coupled to the supply guide 202 and remain in the supply guide 202. In some examples, when the print supplies 212-1, 212-2, 212-3, and 212-N contact a retention mechanism 218 the lock mechanism 204 may be initiated.

In some examples, a print supply 212-1, 212-2, 212-3, or 212-N may be removed from the supply guide 202 by pushing the print supply 212-1, 212-2, 212-3, or 212-N into the supply guide 202 (e.g., push-to-release). In some examples, when the print supplies 212-1, 212-2, 212-3, and 212-N are pushed into the supply guide 202 the print supplies may move away from the retention mechanism 218. In some examples, a print supplies 212-1, 212-2, 212-3, and 212-N may be released by pulling a handle on the print supplies 212-1, 212-2, 212-3, and 212-N. When a print supply 212-1, 212-2, 212-3, or 212-N moves away from the retention mechanism 218 a user may remove the print supply 212-1, 212-2, 212-3, or 212-N from the supply guide 202.

In some examples, the lock mechanism 204 may lock the print supplies 212-1, 212-2, 212-3, and 212-N into the supply guide 202. For example, when the print supplies are inserted into the supply guide 202 the lock mechanism 204 may lift and enter the openings of the print supplies preventing the removal of the print supplies. That is, the lock mechanism 204 may prevent the print supplies 212-1, 212-2, 212-3, and 212-N from moving towards the retention mechanism 218 which may prevent the release of the print supplies.

In some examples, the lock mechanism 204 may prevent the retention mechanism 218 from releasing the print supplies 212-1, 212-2, 212-3, and 212-N when the print supplies 212-1, 212-2, 212-3, and 212-N are inserted into the supply guide 202. In some examples, the lock mechanism 204-1, 204-2, 204-3 or 204-N may prevent an individual print supply 212-1, 212-2, 212-3, or 212-N from moving towards the retention mechanism 218 which may prevent the release of the print supply 212-1, 212-2, 212-3, or 212-N. The lock mechanism 204 may continue to lock the print supplies 212-1, 212-2, 212-3, and 212-N to the supply guide 202 even if the printing device 221 does not receive power.

In some examples, the lock mechanism 204 may engage when there are no print supplies 212-1, 212-2, 212-3, and 212-N in the supply guide 202. If the lock mechanism 204 engages when there are no print supplies 212-1, 212-2, 212-3, and 212-N in the supply guide 202, a user may not be able to insert a print supply 212-1, 212-2, 212-3, or 212-N into the supply guide 202. For example, if a printing device 221 is configured to print a set amount of colors (e.g., one color) the lock mechanism 204 may engage and prevent the print supplies 212-1, 212-2, and 212-3 for other colors from entering the supply guide 202.

In some examples, the lock mechanism 204 may lock the print supply 212-1, 212-2, 212-3, or 212-N into the supply guide 202 when the lock mechanism 204 is engaged. In some examples, the printing device 221 may separately lock each print supply 212-1, 212-2, 212-3, and 212-N. Similarly, the printing device 221 may separately unlock each print supply 212-1, 212-2, 212-3, and 212-N. In some examples, the printing device may lock the print supplies 212-1, 212-2, 212-3, and 212-N when the amount of print substance in the print supplies are above a threshold level.

In some examples, the lock mechanism 204 may include lock indicators 208-2 and 208-N. In some examples, the lock indicators 208-2 and 208-N may be positioned at the distal end of the lock mechanism 204. In some example, the lock indicators 208-2 and 208-N may indicate when the print supplies 212-1, 212-2, 212-3, and 212-N are locked. For example, when the lock mechanism 204 lock the print supplies 212-1, 212-2, 212-3, and 212-N to the supply guide 202 the lock indicators 208-2 and 208-N may display a visual sign to inform the user that the print supplies 212-1, 212-2, 212-3, or 212-N are locked. In some examples, when the lock mechanism 204 are disengaged the lock indicators

208-2 and 208-N may not be visible to the user. In some examples, when the lock indicators 208-2 and 208-N are not visible it may inform the user that the print supplies 212-1, 212-2, 212-3, and 212-N are unlocked.

In some examples, the lock indicators 208-2 and 208-N may prevent damage to the printing device 221 and the supply guide 202. That is, the lock indicators 208-2 and 208-N may visually inform the user that the print supplies 212-1, 212-2, 212-3, and 212-N are locked into the supply guide 202, which may prevent a user from forcibly removing the print supplies 212-1, 212-2, 212-3, and 212-N.

In some examples, the system may include a manual release mechanism 206 to disengage the lock mechanism 204. In some example, the manual release mechanism 206 may disengage the lock mechanism 204 when the amount of print substance in print supplies 212-1, 212-2, 212-3, and 212-N have not reached a threshold level. For example, the printing device 221 may disengage the lock mechanism 204 when a manual release mechanism is actuated. That is the manual release mechanism may cause the lock mechanism 204 to unlock the print supplies 212-1, 212-2, 212-3, and 212-N when the amount of print substance in the print supplies has not reached a threshold level. For example, when the amount of print substance in the print supply 212-2 has not fallen to or below a threshold level the manual release mechanism 206 may cause the lock mechanism 204-2 to unlock the print supply 212-2. In some examples, the manual release mechanism 206 may disengage the lock mechanism 204 when the printing device 221 does not receive power.

In some examples, the manual release mechanism 206 may be hidden from the user. In some examples, the manual release mechanism 206 may be in an obscure location in the enclosure 214. That is, the manual release mechanism 206 may be in a hidden compartment within the enclosure 214. In some examples, in order to access the manual release mechanism 206, the hidden compartment may be opened. In some examples, the manual release mechanism 206 may be disposed in a hole in the enclosure 214. A user may not be able to access the manual release mechanism disposed in the hole without assistance from a thin pole. In some examples, each print supply 212-1, 212-2, 212-3, and 212-N may have a manual release mechanism 206. For example, the manual release mechanism 206 may be connected to the lock mechanism 204. That is, the lock mechanism 204-1, 204-2, 204-3, and 204-N may be pushed down to manually release the lock mechanism 204-1, 204-2, 204-3, and 204-N.

Figure 3:
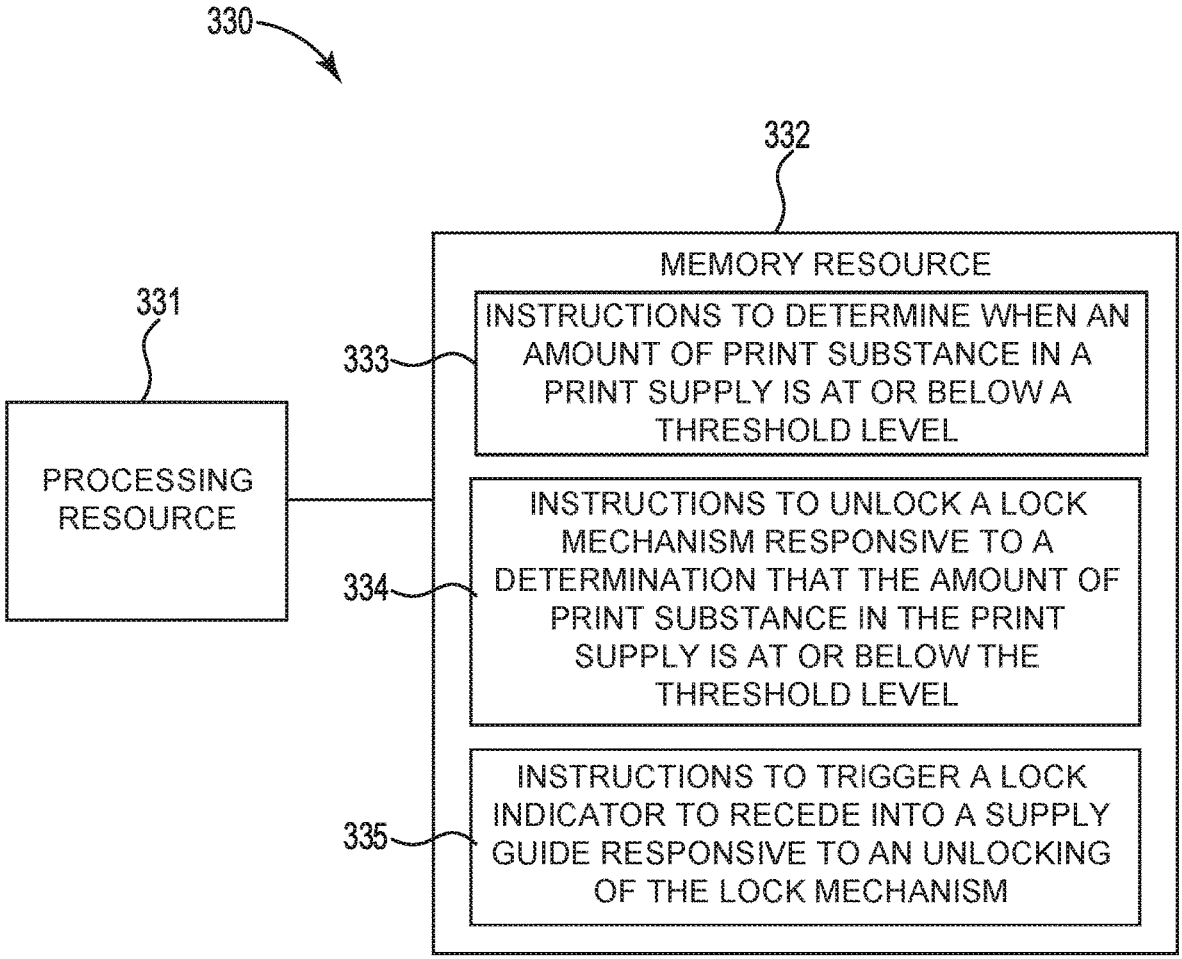
FIG. 3 illustrates an example processing resource and an example memory resource of an example apparatus including a print supply lock.

FIG. 3 illustrates an example processing resource 331 and an example memory resource 332 of an example apparatus 330 including a print supply lock. As illustrated in FIG. 3, the apparatus 330 includes a processing resource 331 and a memory resource 332. The processing resource 331 may be a hardware processing unit such as a microprocessor, application specific instruction set processor, coprocessor, network processor, or similar hardware circuitry that may cause machine-readable instructions to be executed. In some examples, the processing resource 331 may be a plurality of hardware processing units that may cause machine-readable instructions to be executed. The processing resource 331 may include central processing units (CPUs) among other types of processing units. The memory resource 332 may be any type of volatile or non-volatile memory or storage, such as random-access memory (RAM), flash memory, read-only memory (ROM), storage volumes, a hard disk, or a combination thereof.

The memory resource 332 may store instructions thereon, such as instructions 333, 334, and 335. When executed by the processing resource 331, the instructions may cause the apparatus 330 to perform specific tasks and/or functions. For example, the memory resource 332 may store instructions 333 which may be executed by the processing resource 331 to cause the apparatus 330 to determine when the amount of print substance in a print supply is at or below a threshold level. In some examples, when the amount of print substance in a print supply is at or below a threshold level the print supply may be depleted or near depletion and ready for removal.

The memory resource 332 may store instructions 334 which may be executed by the processing resource 331 to cause the apparatus 330 to unlock a lock mechanism responsive to a determination that the amount of print substance in the print supply is at or below the threshold level. In some examples, when the amount of print substance in the print supply is at or below a threshold level, the lock mechanism may disengage allowing a user to remove the print supply from the supply guide. In some examples, when the amount of print substance in the print supply is above a threshold level, the lock mechanism may lock the print supply into the supply guide.

The memory resource 332 may store instructions 335 which may be executed by the processing resource 331 to cause the apparatus 330 to trigger a lock indicator to recede into a supply guide responsive to an unlocking of the lock mechanism. In some examples, when a lock mechanism unlocks a print supply the lock indicator may no longer be visible, informing the user that the print supply may be removed. In some examples, when the lock mechanism locks a print supply to the supply guide the lock indicator may be visible to inform the user that the print supply is locked to the supply guide and cannot be removed.

Figure 4:
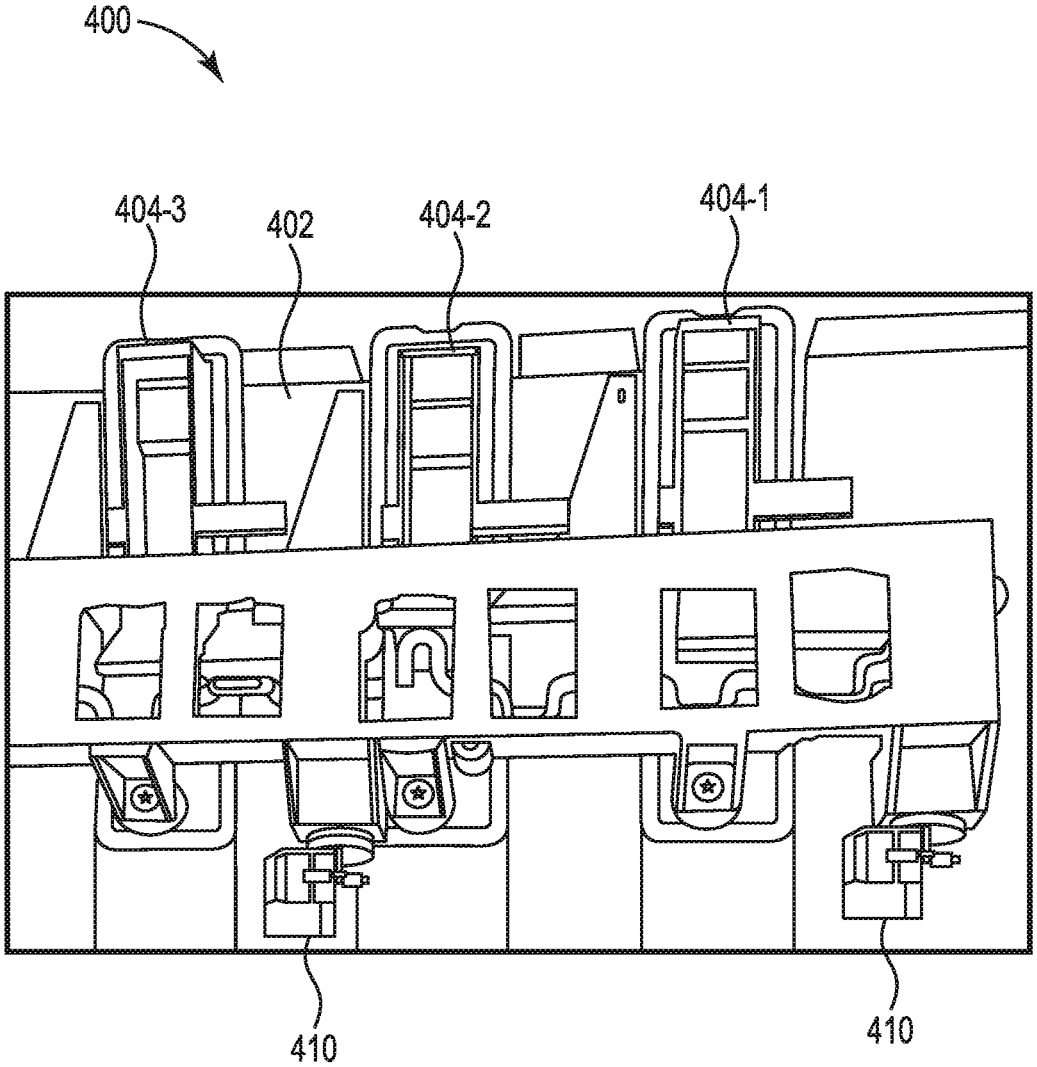
FIG. 4 illustrates a bottom perspective of the example apparatus of FIG. 1.

FIG. 4 illustrates an example apparatus 400 including a print supply lock. In some examples, the apparatus 400 may include a supply guide 402. In some examples, the supply guide 402 may house a print supplies (e.g., print supply 112-1, 112-2, 112-3, and 112-N of FIG. 1). In some examples, the supply guide 402 may be connected to the lock mechanism 404. Lock mechanism 404 collectively refers to 404-1, 404-2, and 404-3. In some examples, the supply guide 402 may connect the lock mechanism 404 to the print supplies. In some examples, the supply guide 402 may include a retention mechanism to hold the print supplies to the supply guide 402.

In some examples, the lock mechanism 404 may lock the print supplies into the supply guide 402. For example, when print supplies are inserted into the supply guide 402 the lock mechanism 404 may lift and enter the openings at the bottom of the print supplies preventing the removal of the print supplies. As illustrated in FIG. 4, lock mechanism 404-2 may move towards the opening at the bottom of the corresponding print supply locking the print supply into the supply guide 402. In addition, as illustrated in FIG. 4, lock mechanism 404-1 and 404-3 may move away from the opening at the bottom of the corresponding print supplies unlocking the corresponding print supplies from the supply guide 402.

In some examples, the apparatus 400 may include an actuator 410 to cause the lock mechanism 404 to lock and unlock the print supplies. In some examples, a plurality of actuators 410 may actuate the lock mechanism 404. For example, when it is determined that the amount of print substance in a print supply is at or below a threshold level the actuators 410 may cause a lock mechanism 404 to disengage and unlock the print supply. In addition, when it is determined that the amount of print substance in a print supply is above a threshold level the actuators 410 may cause the lock mechanism 404 to engage and lock the print supply into the supply guide 402. In some examples, the actuators 410 are servo motors that cause the lock mechanism 404 to lock and unlock the print supplies. In various examples, the plurality of actuators 410 may individually lock and unlock the lock mechanism 404. For example, two or more actuators 410 may be used to individually lock and unlock the lock mechanism 404. In some examples, an individual actuator 410 may individually lock and unlock the lock mechanism 404.

Figure 5:
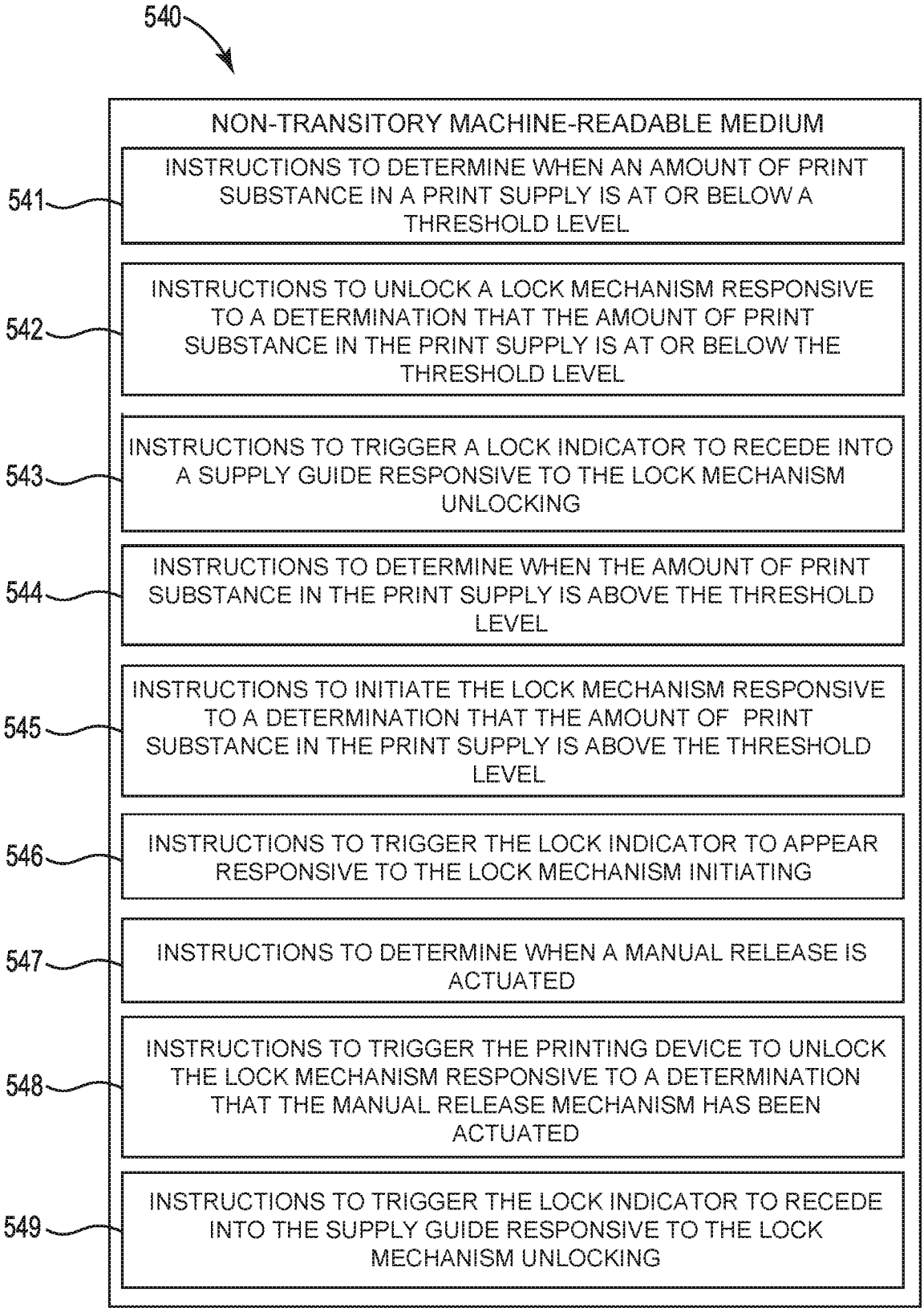
FIG. 5 illustrates an example diagram of a non-transitory machine-readable medium including a print supply lock.

FIG. 5 illustrates an example diagram of a non-transitory machine-readable medium 540 including a print supply lock. A processing resource may execute instructions stored on the non-transitory machine-readable medium 540. The non-transitory machine-readable medium 540 may be any type of volatile or non-volatile memory or storage, such as random-access memory (RAM), flash memory, read-only memory (ROM), storage volumes, a hard disk, or a combination thereof.

The medium 540 stores instructions 541 executable by a processing resource to determine when the amount of print substance in a print supply is at or below a threshold level. In some examples, when the amount of print substance in a print supply is at or below a threshold level the print supply is depleted and ready to be removed from the supply guide.

The medium 540 stores instructions 542 executable by a processing resource to unlock a lock mechanism responsive to a determination that the amount of print substance in the print supply is at or below the threshold level. In some examples, when the amount of print substance in the print supply is at or below a threshold level, the lock mechanism may disengage allowing a user to remove the print supply from the supply guide.

The medium 540 stores instructions 543 executable by a processing resource to trigger a lock indicator to recede into a supply guide responsive to the lock mechanism unlocking. In some examples, the lock indicator may inform a user when it is safe to remove the print supply, That is, if the lock indicator is not visible a user may be allowed to remove the print supply.

The medium 540 stores instructions 544 executable by a processing resource to determine when the amount of print substance in the print supply is above the threshold level. In some examples, when the amount of print substance in the print supply is above a threshold level, the lock mechanism may lock the print supply into the supply guide.

The medium 540 stores instructions 545 executable by a processing resource to initiate the lock mechanism responsive to a determination that the amount of print substance in the print supply is above the threshold level. In some examples, when the amount of print substance in the print supply is above a threshold level, the lock mechanism may engage preventing a user from removing the print supply.

The medium 540 stores instructions 546 executable by a processing resource to trigger the lock indicator to appear responsive to the lock mechanism initiating. In some examples, when the lock mechanism locks a print supply to the supply guide, the lock indicator may be visible to inform the user that the print supply is locked to the supply guide and cannot be removed.

The medium 540 stores instructions 547 executable by a processing resource to determine when a manual release mechanism is actuated. In some examples, when a manual release mechanism is actuated, a lock mechanism may be forced to unlock even though the amount of print substance in the print supply has not reached a threshold level.

The medium 540 stores instructions 548 executable by a processing resource to trigger the printing device to unlock the lock mechanism responsive to the determination that the manual release mechanism has been actuated. In some examples, the manual release mechanism may cause the lock mechanism to unlock the print supply when the amount of print substance in the print supply is above a threshold level.

The medium 540 stores instructions 549 executable by a processing resource to trigger the lock indicator to recede into the supply guide responsive to the lock mechanism unlocking. In some examples, the lock indicator may display a lock sign to inform the user that the print supply is locked. In addition, when the lock mechanism unlocks the print supply the lock sign of the lock indicator may not be visible.

The figures herein follow a numbering convention in which the first digit corresponds to the drawing figure number and the remaining digits identify an element or component in the drawing, Elements shown in the various figures herein may be capable of being added, exchanged, and/or eliminated so as to provide a number of additional examples of the detailed description. In addition, the proportion and the relative scale of the elements provided in the figures are intended to illustrate the examples of the detailed description and should not be taken in a limiting sense.

It should be understood that when an element is referred to as being "on," "connected to", or "coupled to" another element, it may be directly on, in contact, connected, or coupled with the other element or intervening elements may be present.

It should be understood that the descriptions of various examples may not be drawn to scale and thus, the descriptions may have a different size and/or configuration other than as shown therein.

What is claimed:

1. An apparatus comprising:

a supply guide to receive a plurality of print supplies; and a lock mechanism to retain the plurality of print supplies and release a print supply of the plurality of print supplies responsive to a determination that an amount of print substance in the print supply is at or below a threshold level; and a hidden manual release mechanism coupled to the supply guide to disengage the lock mechanism responsive to actuation of the hidden manual release mechanism.

2. The apparatus of claim 1, comprising a lock indicator coupled to the lock mechanism to visually indicate that the plurality of print supplies are locked in the supply guide.

3. The apparatus of claim 2, wherein the lock mechanism is to individually lock the print supply of the plurality of print supplies in the supply guide and prevent removal of the print supply from the supply guide.

4. The apparatus of claim 3, comprising an actuator to actuate the lock mechanism responsive to the determination that the amount of print substance in the print supply is above the threshold level.

5. A system including a print supply lock, the print supply lock comprising:

an enclosure to house a supply guide;

the supply guide to support a plurality of print supplies;

a hidden manual release mechanism that is hidden in the enclosure and that is to disengage a lock mechanism;

a lock indicator to selectively indicate a print supply of the plurality of print supplies is locked to the supply guide; and the lock mechanism to selectively lock and retain the print supply of the plurality of print supplies to the supply guide, wherein the lock mechanism is to disengage responsive to:

a determination that an amount of print substance in the print supply is at or below a threshold level; or actuation of the hidden manual release mechanism.

6. The system of claim 5, comprising a door to cover the enclosure when in a closed position, wherein the door is to initiate the lock mechanism responsive to the door being in the closed position.

7. The system of claim 5, wherein the enclosure is a removable enclosure of a printing device.

8. The system of claim 7, wherein the lock mechanism is to remain locked when power is not received by the printing device.

9. The system of claim 5, wherein the hidden manual release mechanism is coupled to the lock indicator to selectively disengage the lock mechanism for each print supply of the plurality of print supplies responsive to the actuation of the hidden manual release mechanism.

10. The system of claim 5, wherein the print supply is inserted into the supply guide by pushing the print supply into the enclosure and retained in the supply guide by a retention mechanism in the supply guide responsive to the print supply contacting the retention mechanism.

11. The system of claim 10, wherein the print supply is removed from the supply guide by pushing an unlocked print supply into the enclosure.

12. A non-transitory machine-readable medium storing instructions that, when executed by a processing resource, cause the processing resource to:

determine when an amount of print substance in a print supply is at or below a threshold level;

determine when a hidden manual release mechanism is actuated;

unlock a lock mechanism responsive to a determination that the amount of print substance in the print supply is at or below the threshold level or a determination that the hidden manual release mechanism is actuated; and trigger a lock indicator to recede into a supply guide responsive to the lock mechanism unlocking.

13. The medium of claim 12, storing instructions to determine when the amount of print substance in the print supply is above the threshold level;

initiate the lock mechanism responsive to a determination that the amount of print substance in the print supply is above the threshold level; and trigger the lock indicator to appear responsive to the lock mechanism initiating.

* * * * *